US005441247A

United States Patent [19]

Quilliam

[11] Patent Number: 5,441,247

[45] Date of Patent: Aug. 15, 1995

[54] SHEET FEEDING APPARATUS AND METHOD FOR THE SAME

[75] Inventor: Jon Quilliam, Snohomish, Wash.

[73] Assignee: EMF Corporation, Redmond, Wash.

[21] Appl. No.: 104,415

[22] Filed: Aug. 9, 1993

[51] Int. Cl.[6] ..... B65H 5/00

[52] U.S. Cl. ..... 271/10.04; 271/265.02; 271/10.06

[58] Field of Search ..... 271/4, 10, 265

[56] References Cited

U.S. PATENT DOCUMENTS

| | | | |
|---|---|---|---|
| 3,947,016 | 3/1976 | Horung et al. | 271/12 |
| 4,702,466 | 10/1987 | DuBois | 271/10 |
| 4,838,534 | 6/1989 | Ishikawa et al. | 271/10 |

FOREIGN PATENT DOCUMENTS

| | | | |
|---|---|---|---|
| 2501406 | 7/1975 | Germany | 271/10 |
| 2420078 | 11/1975 | Germany | 271/10 |
| 0078024 | 5/1984 | Japan | 271/4 |

*Primary Examiner*—H. Grant Skaggs
*Assistant Examiner*—Carol L. Druzbick
*Attorney, Agent, or Firm*—Stephen M. Evans; David L. Garrison

[57] ABSTRACT

An apparatus and method for feeding cut sheets to an end device such as a printer or duplicator is disclosed. The feeding apparatus has a sheet storage assembly with a feeder mechanism. Sheets are removed from the storage assembly and delivered to a staging assembly having a sheet directing portion and a cassette interface portion. Each portion has a sheet transport surface to define an overall transport surface. The cassette interface portion has an exposed sheet conveyor characterized as a first exposed pinch roller being mechanically linked to a second pinch roller. Sheets are delivered to the sheet directing portion in response to a first sheet sensor located at the transport surface of the sheet directing portion activating the feeder mechanism. The delivered sheets are caused to engage the upstream pinch roller which conveys a first sheet to a holding position on the sheet directing portion. Once at the holding position, further conveyance is stopped by way of a second sheet sensor located at the transport surface of the cassette interface indicating that a sheet is present thereon. A second sheet is then delivered to the sheet directing portion and caused to engage the first sheet in an underlapping relationship and also engage the upstream pinch roller. Advancement of the first sheet in response to the end device causes the mechanically linked first and second pinch rollers to advance both sheets together. The second sheet then replaces the first sheet in a similar position and the process is repeated.

11 Claims, 4 Drawing Sheets

SHEET FEEDING APPARATUS AND METHOD FOR THE SAME

FIELD OF THE INVENTION

The present invention relates to a cut sheet storage assembly operatively linked to a sheet staging assembly so as to replace a conventional sheet tray, or the like, in an image printing device to provide an ultra high sheet capacity accessory for imaging devices.

BACKGROUND OF THE INVENTION

As imaging technology advances, the quality of output as well as the quantity of output per unit time continues to increase. In response to these advances, higher quality print substrates have been proposed and utilized, and more reliable and larger capacity sheet feeding mechanisms have been incorporated. Most notably, the speed of printing, especially in duplicating devices, has increased dramatically in recent years. As a consequence of this increase in output speed, higher capacity sheet storage devices have become desirable. Many of these storage devices have been integral with the printing or duplicating units as generally only dedicated, high-speed units have needed such capacity. However, medium to high speed printing and duplicating machines have become increasingly available at prices affordable by small business.

Unfortunately, these devices, while quick and generally reliable, have limited sheet capacity due in large part to the costs (and size) of providing a dedicated, high capacity storage device for light duty units. Thus, a need exists to provide a simple accessory to store large quantities of cut sheets for use in non specialized printing and duplicating. Preferably, such a device would be transportable and interface easily with a variety of printing and duplicating devices.

A constant concern in the image producing industry is sheet feed jamming. The possibility of sheet jams in a printing or duplicating device requires that a person monitor the progress of the print job, identify the location of a jam, clear the jam, and resume the print job. It is therefore important that any high capacity printing or duplicating device utilize a reliable means for transporting a sheet from a stack of sheets to minimize jam potential. Such a means becomes even more important when utilizing a large capacity feeder that is designed to replace an original equipment component. Previous efforts to provide a non-integrated, large capacity sheet feeding accessory have often relied upon sequentially presenting sheets to the feeder mechanism of the printing device and/or sensing the startup and rotation rate of the feeder mechanism to trigger a complimentary response in the sheet transport mechanism associated with the accessory. Such efforts have resulted in complex devices often times having less than desirable reliability.

SUMMARY OF THE INVENTION

The present invention concerns a transportable, high capacity sheet feeding apparatus having two main components, namely a sheet storage assembly and a sheet staging assembly. The sheet storage assembly is characterized as a generally rectangular column having a movable base located internal to the column. The rectangular column is dimensioned to permit the movable base and a stack of cut sheets to move freely up or down the column. Linked to the base is a biasing means which urges the base upwardly and preferably downwardly. Located at the top of the sheet storage assembly is a feed mechanism that distributes sheets from the stack of sheets to the sheet staging assembly in response to a signal.

The sheet staging assembly is operatively linked to the sheet storage assembly and to an end device that utilizes the stored sheets of paper, thereby creating a sheet transport path between the sheet storage assembly and the end device. The sheet staging assembly is characterized as a dual platform having a sheet directing portion and a cassette interface portion. The sheet directing portion receives sheets delivered from the sheet storage assembly via the feed mechanism thereof and directs the sheets to the cassette interface portion. The cassette interface portion has a sheet transport surface slightly elevated from the sheet exit location of the sheet directing portion. Thus, a sheet traveling from the sheet storage assembly to the end device via the sheet staging assembly is deflected towards the slightly elevated transport surface of the cassette interface portion. As will be described in further detail below, the transport surface of the cassette interface portion is not continuous over the length of the cassette interface portion but instead exposes a void into which a portion of the sheet directing portion resides, namely the sheet redeflecting member.

The cassette interface portion is further characterized as having a conveying means linked by way of a one-way clutch to a drive means. The conveying means extends above the transport surface and causes a sheet located thereon to move in response thereto. The conveying means can be in the form of a unitary belt or at least a first and second roller linked by a belt so that movement of one roller causes a proportional movement of at least a second roller. In an embodiment having two rollers, at least one roller is linked to a drive means. The drive means, which is preferably an electric motor, is engagable with the at least one roller by way of a one way clutch thereby either invoking active rotation of the at least one roller, or permitting passive rotation of the same by other means. When linked to an end device, a feed roller associated with the end device frictionally contacts a roller associated with the cassette interface portion so that rotation by the end device feed roller causes a proportional rotation of the cassette interface portion rollers. When a sheet is present on the transport surface of the cassette interface portion, movement of the sheet, when engaged by the end device feed roller, imparts rotational movement of the cassette interface portion rollers.

In addition to the aforementioned elements of the cassette interface portion, at least two sensing means are provided in the sheet staging assembly. These sensing means provide the necessary information to control the advance of sheets from the sheet storage assembly to the end device. In a preferred embodiment, a first sensing means is disposed in the sheet transport path of the sheet directing portion. When a sheet has not engaged the first sensing means, the sensing means causes the feed mechanism associated with the sheet storage assembly to activate and thus advance a single sheet of paper. The advancing sheet then engages the first sensing means and causes the first sensing means to deactivate the feed mechanism. A timing means is used to continue operation of the feed mechanism for a predetermined period after the first sensing means would otherwise cause the feed mechanism to stop. The second sensing means is disposed in the sheet transport path of the cassette interface portion. When a sheet has not engaged the second sensing means, the sensing means causes the drive means linked to the conveying means of the cassette interface portion to activate and advance any sheet present thereon. An advancing sheet then causes the second sensing means to deactivate the drive means. A timing means associated with the second sensing means may continue sheet advancement for a predetermined period after the second sensing means would otherwise cause the drive means to stop, thereby ensuring proper positioning of the sheet on the transport surface. At the end of the period, sheet advancement is stopped. Alternatively, the conveying means may be controlled without the use of a timing means by relying instead upon the placement of the sensing means.

A feature of the invention provides for underlapping each successive sheet with a previous sheet during the staging process. More particularly, a first sheet is transported from the sheet storage assembly and advanced to the upper surface of the cassette interface portion. As previously described, a first sheet being delivered to the cassette interface portion is deflected by the sheet directing portion. It is then delivered via the conveying means of the cassette interface portion and brought to rest on the upper surface of the cassette interface portion so that the trailing edge and surrounding portion of the first sheet are not in contact with the transport surface of the cassette interface portion. Instead, the trailing edge and related portion is generally in a position above the deflecting portion of the sheet directing portion. Thus, the location of subsequent sheet deflection occurs intermediate the leading and trailing edges and preferably adjacent the portion of the sheet associated with the first trailing edge thereof.

When a second sheet is delivered from the sheet storage assembly, the leading edge of the second sheet is intentionally directed towards the trailing edge and related portion of the first sheet, thus causing an underlapping relationship between the first and second sheets. This second sheet is then parked so as to occupy a portion of the sheet directing portion and the cassette interface portion and is frictionally lodged against the conveying means. As a consequence of this underlapping relationship, when the first sheet is taken up by the feed roller of the end device, the second sheet is also taken up and the two sheets move in unison. The second sheet advantageously parks in a position generally similar to the location of the first sheet. Thus, the end device is always presented with a single sheet of paper. More importantly however, the end device take-up rollers, for example, are never presented with a unitary leading edge of a sheet after initial setup of the apparatus. Instead, the sheets are presented as a continuous stream of paper, with each subsequent sheet underlapping a previous sheet thereby emulating the process of sheet advancement occurring in an original equipment setup.

It should be understood that variations as to form are possible. For example, an overlapping relationship could be used if the transport rollers associated with the cassette interface portion are located overhead so that the transport rollers contact the subsequently deposited sheet. The essence of the invention is to present sheets to an end device that are in an under- or overlapping relationship so as to avoid presenting leading edges of sheets to the end device.

An additional benefit of the present invention is that by relying on the feed roller(s) of the end device for sheet advancement, timing, and takeup, an extremely simple and highly reliable high capacity sheet storage and delivery device is created.

DETAILED DESCRIPTION OF THE INVENTION

Figure 1:
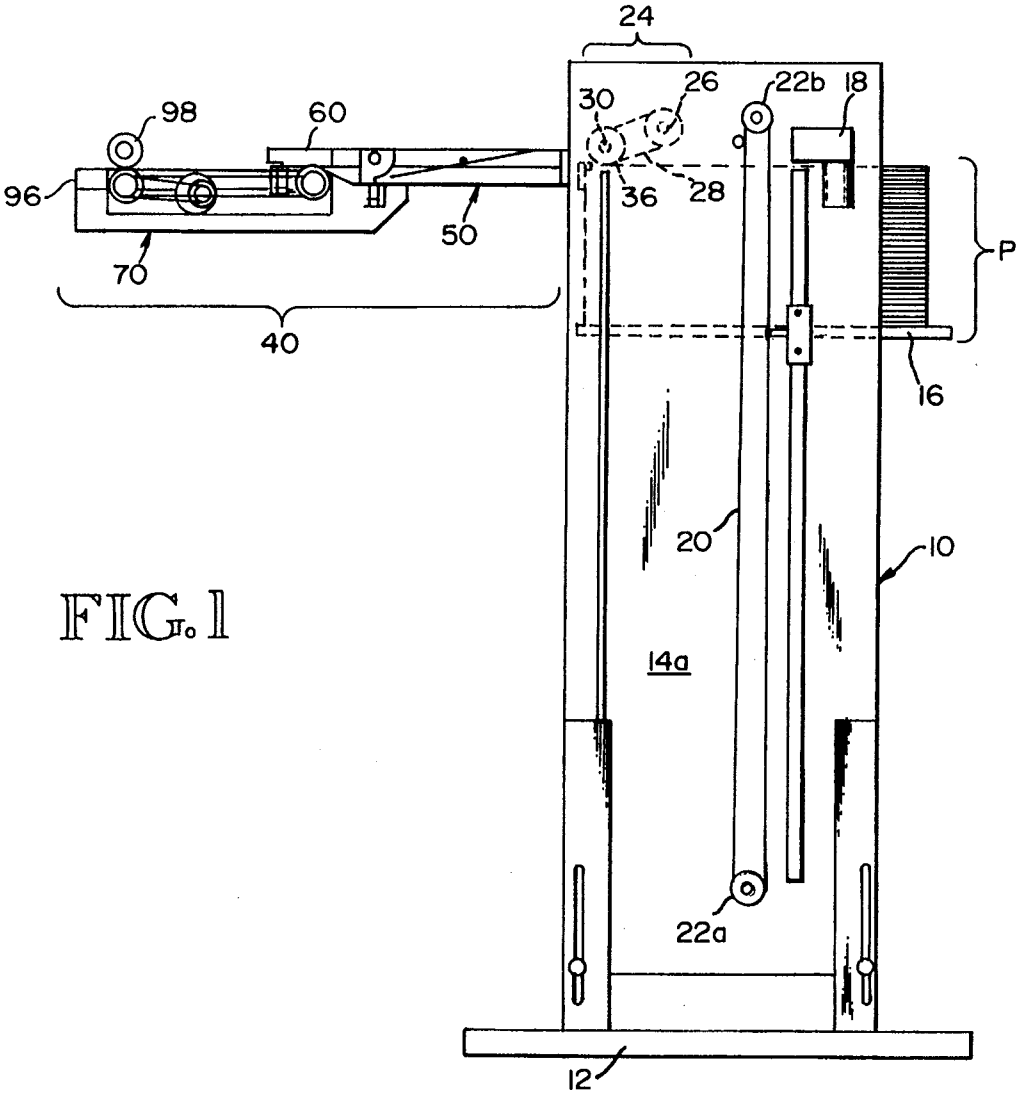
FIG. 1 is a side elevational view of the invention with components of the sheet storage assembly shown in phantom and the sheet staging assembly shown in cross section.

The following is a detailed description of the invention wherein like numerals indicate like parts. Turning then to FIG. 1, a side elevational view of the invention is shown in cross section. The invention generally comprises sheet storage assembly 10 and sheet staging assembly 40 which operatively links sheet storage assembly 10 to an end device (not shown). The end device may be any imaging system that preferably utilizes a cassette type sheet storage accessory.

Turning first to sheet storage assembly 10, the basic configuration thereof is shown. Sheet storage assembly 10 generally comprises base 12 surrounded by enclosing panels 14*a–d* (only 14*a* is shown). A movable sheet platform 16 is disposed therein and travels essentially the entire vertical distance between base 12 and the upper portion of assembly 10. Motion of platform 16 is imparted by activation of elevation motor 18 which is linked thereto by way of belt 20 and pulleys 22*a* and 22*b*. As is shown in FIG. 1, movable platform 16 is fixedly attached to belt 20 so that movement of belt 20 causes corresponding movement of platform 16.

Residing on platform 16 is a stack of cut sheets which are collectively referred to as P. Preferably, sheet storage assembly 10 is sized so as to hold 3,000 to 5,000 sheets of paper. A sheet from stack P is removed by way of feeder mechanism 24 which comprises drive shaft 26, belt 28, and driven shaft 30. Both shaft 26 and shaft 30 are located on crank members (not shown). An actuator (not shown) causes pivotal motion of feeder mechanism 24 in response to an appropriate signal which will be discussed in more detail below.

As sheets are removed from the stack P, feeder mechanism 24 must necessarily pivot downwardly to engage the stack. Because of the limited range pivot range of feeder mechanism 24 as well as the fixed location of sheet staging assembly 40, stack P must periodically be moved upwardly. Sensing means therefore are coupled to feeder mechanism 24 to sense the degree of pivot thereof and cause elevational changes of movable platform 16. Sensing means can be optical switches such as photoelectric detectors, mechanical switches such as microswitches, or optimechanical switches; in the present embodiment the sensing means are mechanical microswitches.

Figure 2:
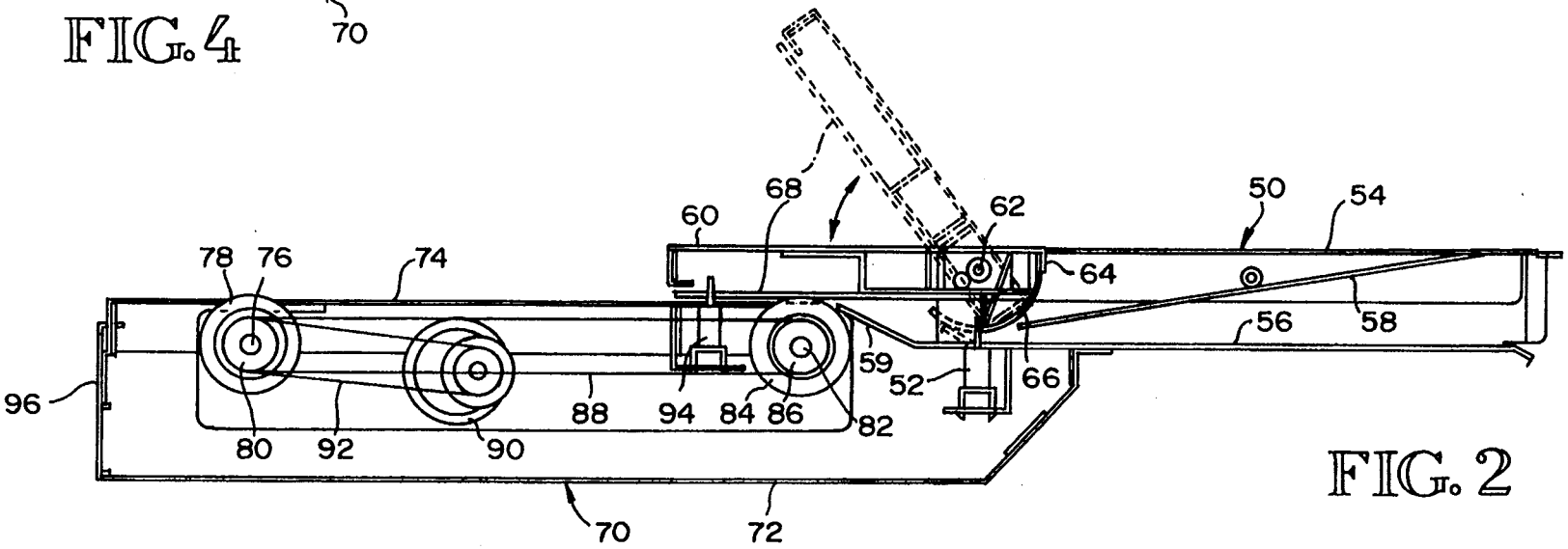
FIG. 2 is an enlarged cross section of the sheet staging assembly showing the sheet directing portion and the cassette interface portion, and various internal components thereof with the access cover shown in an open position in phantom.

A cross section view of the sheet staging assembly 40 is shown best in FIG. 2. Sheet staging assembly 40 has two main components which are separately identified for convenience, namely sheet directing portion 50 and cassette interface portion 70. Sheet staging assembly 50 is operatively linked to sheet storage assembly 10 and to the end device that utilizes the stored sheets, and thereby defines a sheet transport path between sheet storage assembly 10 and the end device. Sheet directing portion 50 is generally sized slightly larger than the dimensions of the sheets to be handled. Externally, sheet directing portion 50 has access cover 60 connected to hinge shaft 62 which transverses the width of assembly 50. Located at hinged end 64 is arcuate surface 66. Additional internal components to sheet directing portion 50 include deflecting member 58 and sheet sensing means in the form of microswitch 52. As with the sensing means associated with feed mechanism 24, such means include optical, mechanical, or optimechanical sensors. Deflecting member 58 is preferably a wire assembly attached to the upper surface of sheet directing portion 50 and suspended in downward direction therefrom, although other means for deflecting moving sheets such as a planar surface may be appropriate given design considerations. Microswitch 52 is located in the sheet transport path and is a normally closed type. Microswitch 52 is designed to detect the presence or absence of sheet in the transport path. If sheet is present, microswitch 52 opens an electrical circuit. The purpose of this switch will be discussed in more detail in the method of operation section.

Attached to sheet directing portion 50, in a generally off set and underneath manner, is cassette interface portion 70. Cassette interface portion 70 is generally of the same dimensions as sheet directing portion 50, although the sheet output end is sized so as to be receivable in a desired printing or duplicating device—the end device. Cassette interface portion 70 generally comprises housing 72 which defines transport surface 74; sheet advancing means in the form of shaft 76, roller 78, and pulley 80, and shaft 82, roller 84, and pulley 86; connecting belt 88; motor 90; drive belt 92; and sheet sensing means in the form of normally electrically closed microswitch 94.

Both shaft 76 and shaft 82 are rotatably located transverse to the direction of sheet travel in housing 72. Generally centrally disposed on shaft 76 is roller 78, and on shaft 82 is roller 84. Operationally linking shaft 76 and shaft 82 is connecting belt 88 by means of pulley 80 and pulley 86. In a preferred embodiment, belt 88 is outside of the transport path as defined by transport surface 74. In addition, motor 90 is linked to either shaft 76 or 82, but preferably shaft 76, by way of drive belt 92. Although not shown in the several drawings, this linkage is by way of a clutch mechanism that permits drive belt 92 to impart rotational motion of shaft 76, but when drive bias is reversed (the rotational force originates at either shaft as opposed to originating at motor 90), shaft 76 as well as shaft 82 are permitted to turn freely.

Both roller 78 and 84 extend slightly beyond transport surface 74 to as to tangentially engage a sheet that may be deposited thereon. Thus, rotation of a roller will cause a sheet to move along transport surface 74. As will be described later, roller 84 interacts with pinch portion 68 of access cover 60 to cause a sheet located therebetween to positively move in response to rotational movement of roller 84. As those persons skilled in the art will appreciate, pinch portion 68 may be a stationary low friction surface or a roller type element depending upon design considerations.

Microswitch 94 is a normally electrically closed type and is located between shaft 76 and shaft 82 and extends beyond transport surface 74 to detect the presence or absence of sheet thereon. It is preferably electrically coupled to a timing circuit that activates motor 90 and only deactivates motor 90 after a predetermined period of time has passed since microswitch 94 indicates that a sheet is present (electrically open). Alternatively, motor 90 can be deactivated when the trailing edge of a sheet clears microswitch 52, thus corresponding to proper sheet position on transport surface 74.

OPERATION OF THE INVENTION

Figure 3:
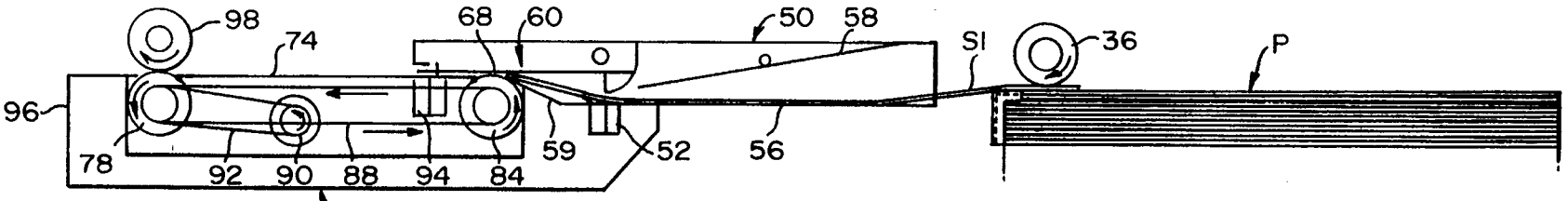
FIG. 3 is a cross section of the sheet staging assembly and a stack of sheet as a first sheet is drawn from the stack and delivered to the sheet staging assembly.
Figure 4:
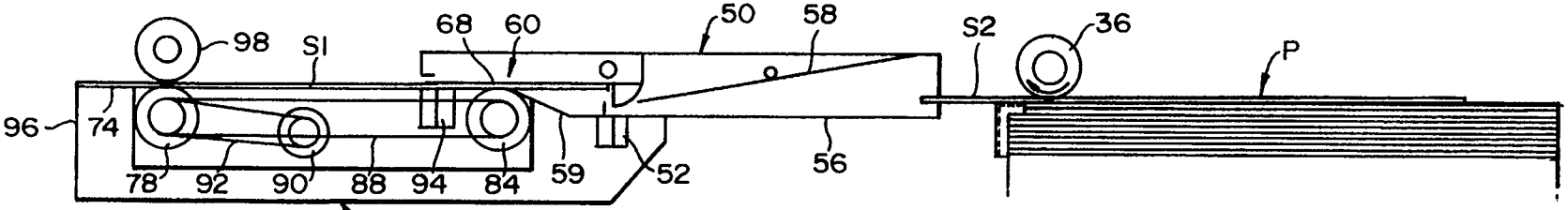
FIG. 4 is a view similar to FIG. 3 but shows the delivered sheet resting upon a support surface of the cassette interface portion.
Figure 5:
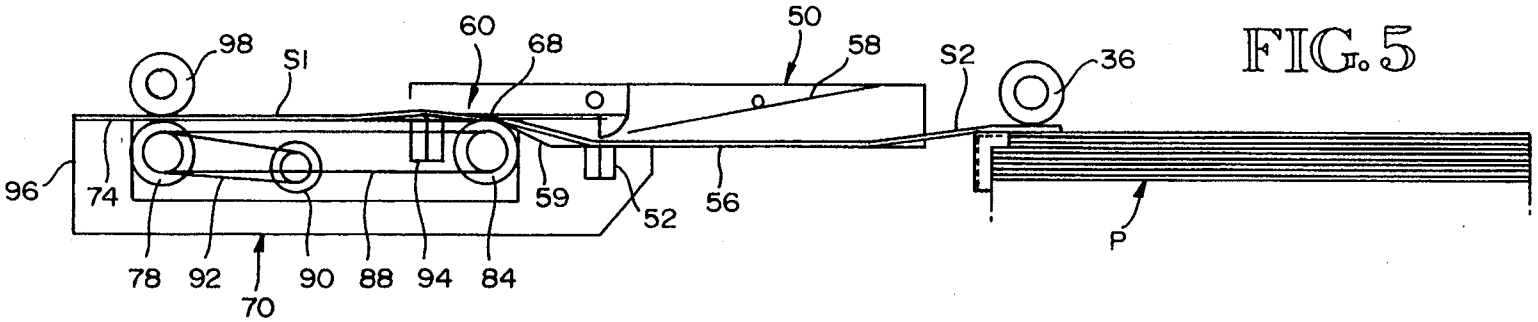
FIG. 5 is a view similar to FIG. 4 but shows a second sheet of sheet being delivered to the sheet directing portion and engaging a leading edge with a roller associated with the cassette interface portion.
Figure 6:
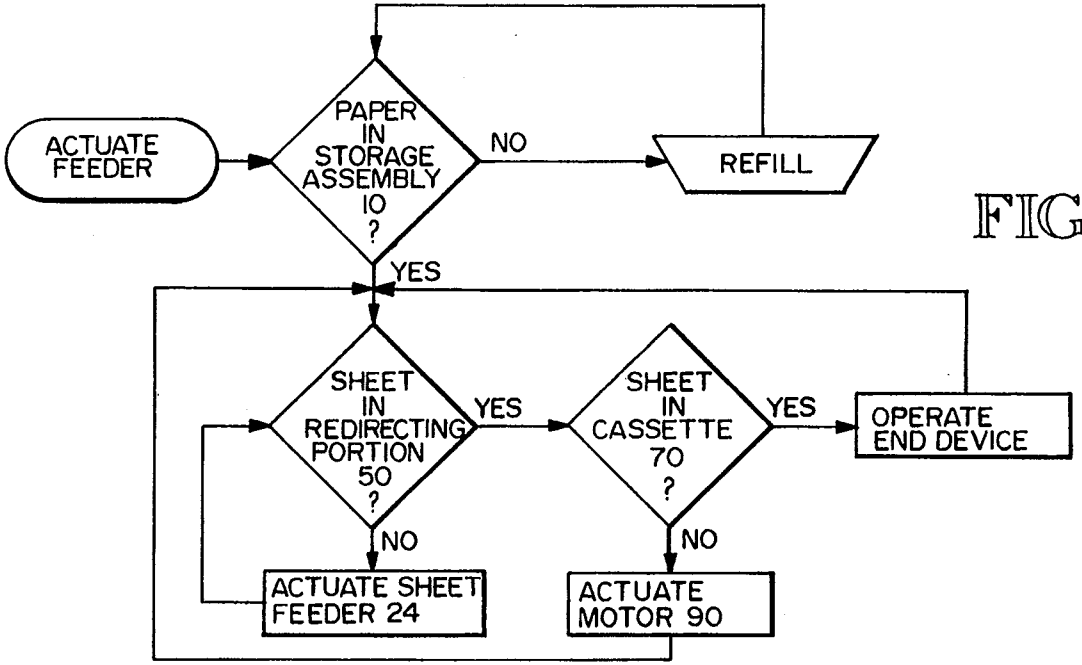
FIG. 6 is a flow diagram showing the processing logic of the invention.

Referring now to FIGS. 3, 4, and 5, and to FIG. 6 for logic processes, the operation of the invention will be described. Both microswitch 52 and microswitch 94 have created a closed circuit as both switches detect the absence of sheet in the transport path. The circuit associated with microswitch 52 causes activation of feeder mechanism 24 (see FIG. 1) which in turn causes a sheet S1 to be removed from the stack of sheet P by rotational action of friction rollers 36. As the leading edge of sheet S1 trips microswitch 52, feeder mechanism 24 stops after a predetermined interval. The timed interval is calculated to coincide with the leading edge of sheet S1 arriving at roller 84 (see FIG. 3). Sheet S1 enters sheet directing portion 50 and the leading edge of sheet S1 is subsequently delivered to roller 84.

Microswitch 94, which detects the absence of sheet in the transport path, has created a closed electrical circuit as previously described. Consequently, motor 90 activates and causes rotation of shaft 76 via drive belt 92, and rotation of shaft 82 via connecting belt 88. This action causes sheet S1 to be further delivered to transport surface 74 as shown best in FIG. 4. As described previously regarding microswitch 52 and feeder mechanism 24, motor 90 ceases rotation after a predetermined time interval has passed since the leading edge of a sheet has engaged microswitch 94. This time interval is calculated so as to position a sheet in a location substantially as shown in FIG. 4. Alternatively, proper sheet placement on transport surface 74 can be accomplished without timing means by relying on the placement of microswitch 52. As shown in FIG. 4, sheet S1 is in proper position when its trailing edge has just cleared microswitch 52. Thus, by immediately deactivating motor 90 when this condition is true (microswitch 94 engaged and microswitch 52 not engaged), accurate sheet positioning can be obtained. As can be seen, the majority of sheet S1 is supported by transport surface 74 while a rear portion of sheet S1 overhangs the void defined by pinch portion 68 of access cover 60 and redeflecting member 59.

As sheet S1 is removed from transport surface 56 of sheet directing portion 50 and is deposited on transport surface 74 of cassette interface portion 70, microswitch 52 once again detects the absence of a sheet at this location. Thus, rotational motion of friction rollers 36 of feeder mechanism 24 again begins and delivers a second sheet, S2, to transport surface 56.

As best shown in FIG. 5, the leading edge of sheet S2 is generally in frictional contact with roller 84. Hence, when roller 84 begins rotational motion, sheet S2 will be drawn towards transport surface 74. By positioning the leading edge of sheet S2 at roller 84, sheet S2 is in underlapping relationship with sheet S1.

Sheets S1 and S2 remain in these positions until end device feed roller 98 begins to rotate. At this point, sheet S1 begins to move toward output end 96. Rotation of feed roller 98 causes shaft 76 to rotate in a complimentary direction. Connecting belt 88 distributes this rotational motion to shaft 82 which is attached to roller 84. In this configuration, both roller 78 and roller 84 are passively driven by feed roller 98. Thus, advancement of both sheets S1 and S2 are directly determined by the end device without using potentially complicated sensors, motor, and processors to determine when and how fast to present sheets to the end device. As mentioned previously, the interaction between feed roller 98 and roller 78 causes sheet S1 to move towards output end 96. Further rotation of roller 84 causes sheet S2 to also be transported towards output end 96 as the leading edge of sheet S2 was previously engaged with roller 84. Consequently, both sheets move in unison, in the underlapped configuration, until sheet S2 clears microswitch 52. At this point, switch 52 causes friction rollers 36 to rotate whereby sheet S3 is removed from the stack of sheets P and delivered to transport surface 56 of sheet directing portion 50.

Because microswitch 94 senses a sheet during normal operation of the invention, motor 90 remains inactive and rollers 78 and 84 are driven in response to moving sheets by the frictional rotation of feed roller 98. New sheets are delivered to sheet staging assembly 40 only when microswitch 52 senses the absence of a sheet. Once microswitch 52 senses a sheet, the switch again opens and invokes a timing circuit that continues operation of feeder mechanism 24 for a time sufficient to cause the leading edge of sheet S2 to lodge between sheet S1 and roller 84. Alternatively, feeder mechanism 24 can be disengaged and the momentum of sheet S2 will cause it to lodge between sheet S1 and roller 84 assuming that resistance by friction rollers 36 is not significant.

For very high speed applications, the sheet storage assembly may be linked to the sheet staging assembly so as to permit total release of a sheet after being fully deposited thereon and partially deliver another sheet thereto. In this manner, the distance between the leading edge of a sheet from the stack of sheets residing in the sheet storage assembly is closer to the first sensing means and pinch portion of the sheet directing portion, thereby decreasing the sheet advance time associated with positioning a leading edge of a sheet to engage the pinch and roller.

What is claimed is:

1. A method for transporting two sheets in an underlapping relationship from a sheet storage assembly to a sheet accepting device comprising the steps of:

a) delivering a first sheet to a sheet transport surface having a conveying means in frictional contact with said first sheet so that a trailing edge portion of said first sheet extends beyond said conveying means towards said sheet storage assembly;

b) delivering a leading edge of a second sheet to said conveying means and frictionally engaging said leading edge with said first sheet;

c) positioning a sheet advancement means associated with said accepting device in compressive contact with said conveying means wherein said first sheet is intermediate said sheet advancement means and said conveying means; and d) rotating said sheet advancement means thereby causing both sheets to move in unison.

2. In combination with a sheet accepting device having a sheet advance mechanism, a sheet feeding apparatus comprising:

a sheet storage assembly to hold a stack of sheets having a feeder mechanism engagable with said sheets;

a sheet staging assembly operably linked to said sheet storage assembly and having an output end associated with said sheet accepting device and an input end associated with said sheet storage assembly comprising a sheet directing portion having a sheet transport surface at said input end, and a cassette interface portion having a sheet transport surface at said output end wherein said cassette interface portion has a sheet conveying means extending beyond said sheet transport surface thereof, a motor linked to said sheet conveying means and a second sheet sensing means, and wherein said sheet directing portion has a pinch portion located adjacent to said sheet conveying means, and a first sheet sensing means, said sheet directing portion and said cassette interface portion being operably linked together to form a single sheet transport path wherein said second sheet sensing means permits activation of said motor when a sheet has not engaged said second sheet sensing means, and said first sheet sensing means permits activation of said feeder mechanism when a sheet has not engaged said first sheet sensing means; wherein said sheet staging assembly causes a first sheet to temporarily contact said sheet conveying means and said pinch portion while a leading edge of a second sheet is frictionally engaged with said sheet conveying means so as to create an underlapping relationship with said second sheet; and wherein the advance mechanism associated with said sheet accepting device causes said first sheet and said second sheet to be transported along said sheet staging assembly.

3. The apparatus of claim 2 wherein said sheet conveying means comprises a conveyor type belt.

4. The apparatus of claim 3 wherein said conveyor type belt is frictionally engagable by said sheet advance mechanism.

5. The apparatus of claim 2 wherein said sheet conveying means comprises at least a first and second roller operatively linked to one another.

6. The apparatus of claim 5 wherein said first roller is located proximate to said pinch portion and said second roller is frictionally engagable by said advancement mechanism.

7. The apparatus of claim 2 wherein said first and second sheet sensing means comprise optical sensors.

8. The apparatus of claim 2 wherein said first and second sheet sensing means comprise mechanical sensors.

9. The apparatus of claim 2 wherein said first and second sheet sensing means comprise opti-mechanical sensors.

10. A method for transporting a plurality of sheets downstream from a stack of sheets to an end device having exposed means for advancing a sheet thereinto comprising the steps of:

a) delivering a first sheet from a stack of sheets to a first position on a sheet staging assembly wherein said first position enables said first sheet to be frictionally engagable with said advancing means of said sheet accepting device;

b) delivering a second sheet from a stack of sheets to a second position on said sheet staging assembly wherein a downstream portion of said second sheet is positioned so as to be in frictional contact with said first sheet;

c) engaging said advancing means of said sheet accepting device with said first sheet, thereby causing said first sheet to be drawn thereinto whereby said frictional contact between said first sheet and said second sheet causes said second sheet to be delivered to said first position at which time said frictional contact no longer exists;

d) delivering a third sheet from said stack of sheets to said second position so that a downstream portion of said third sheet is positioned so as to be in frictional contact with said second sheet; and e) repeating steps c) and d) as desired.

Figure 2A:
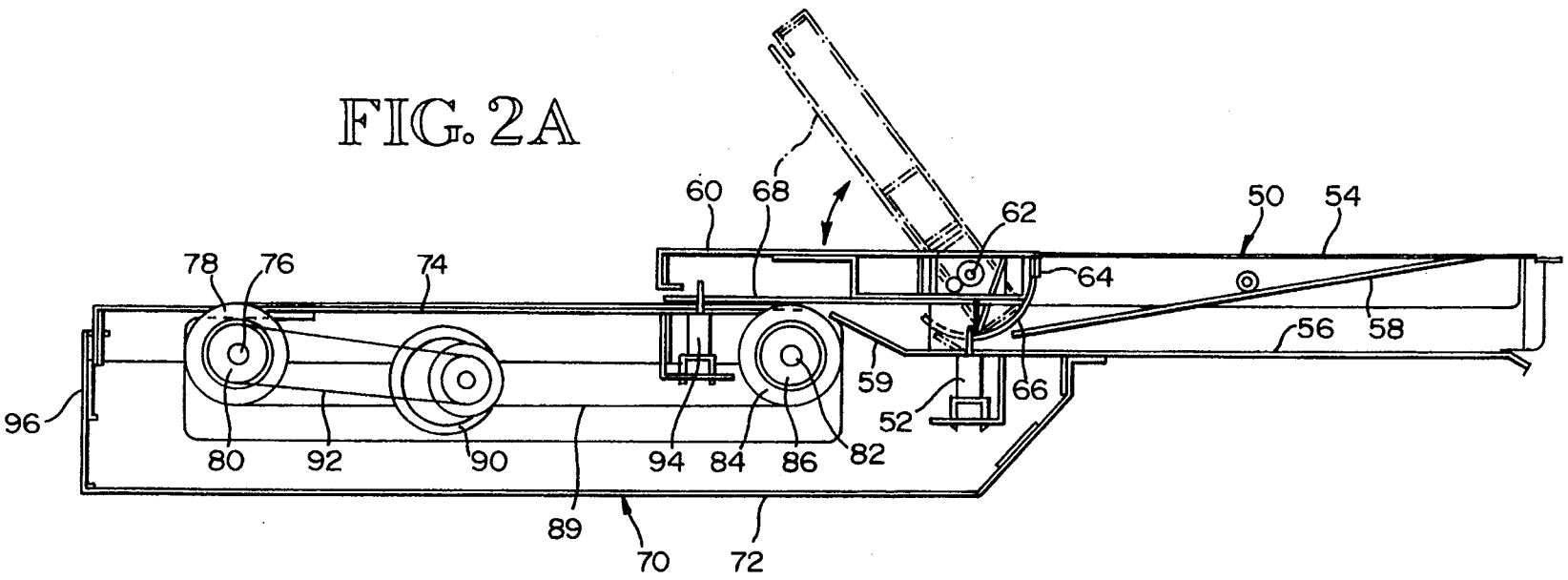
FIG. 2A is similar to FIG. 2 but an external conveyor type belt links the two sheet transport rollers of the cassette interface portion to thereby provide a moving transport surface for delivering sheets from the sheet redirecting portion and to permit the sheets to be frictionally engagable by an end device feed roller.

11. A method of constructing a sheet staging assembly for delivering sheets from a large capacity sheet storage device having a sheet feeding mechanism to a sheet accepting device comprising the steps of:

a) constructing a sheet directing assembly characterized as having a sheet transport surface so as to allow linear movement of a sheet of material therein, said sheet directing assembly having a sheet receiving end matable with said sheet storage device and a delivery end;

b) forming an upswept sheet deflecting portion at said delivery end;

c) locating a first sheet sensing means in said transport path wherein said sensing means is electromagnetically linkable to said sheet feeding mechanism;

d) constructing a cassette interface assembly characterized as having a sheet transport surface so as to allow linear movement of a sheet of material therein, said cassette interface assembly having a sheet receiving end formed to integrate with said sheet delivery end of said sheet directing assembly and a delivery end matable with a sheet receiving portion of said sheet accepting device;

e) locating a sheet conveying means at said receiving end of said cassette interface assembly wherein a portion of said sheet conveying means is in close opposing proximity to a portion of said sheet directing assembly so as to form a pinch portion thereat; and f) locating a second sheet sensing means in said transport path of said cassette interface wherein said sensing means is electromagnetically linkable to said sheet conveying means. An alternative embodiment shown in FIG. 2A has belt 88 (see FIG. 2) replaced by external conveyor type belt 89. In this manner, conveyor type belt 89 not only transmits rotational motion of roller 78 to roller 84 when roller 78 is driven by motor 90, but also provides a moving transport surface for sheets of paper P when end device roller 98 is in frictional contact with cassette interface assembly 70 (see for example FIG. 3).

* * * * *

UNITED STATES PATENT AND TRADEMARK OFFICE

CERTIFICATE OF CORRECTION

PATENT NO. : 5,441,247

DATED : August 15, 1995

INVENTOR(S) : Quilliam

It is certified that error appears in the above-indentified patent and that said Letters Patent is hereby corrected as shown below:

Column 10, line 27, text beginning with "An alternative" and ending with "(see for example Fig. 3)"should be a new paragraph moved to column 6, line 29.

Signed and Sealed this

Thirty-first Day of October 1995

*Attest:*

Bruce Lehman

BRUCE LEHMAN

*Attesting Officer*

*Commissioner of Patents and Trademarks*